US005659954A

United States Patent [19]

Ikeda et al.

[11] Patent Number: 5,659,954

[45] Date of Patent: Aug. 26, 1997

[54] METHOD OF ASSEMBLING WIRE HARNESSES

[75] Inventors: Hirokazu Ikeda; Kenji Kojima; Kousei Nogami; Satoshi Amihiro, all of Yokkaichi, Japan

[73] Assignee: Sumitomo Wiring Systems, Ltd., Japan

[21] Appl. No.: 425,890

[22] Filed: Apr. 21, 1995

[30] Foreign Application Priority Data

Jun. 10, 1994 [JP] Japan ..... 6-128691

[51] Int. Cl.[6] ..... H01R 9/00

[52] U.S. Cl. ..... 29/854; 29/755

[58] Field of Search ..... 29/755, 33, 854

[56] References Cited

U.S. PATENT DOCUMENTS

| | | | |
|---|---|---|---|
| 2,805,471 | 9/1957 | Lowden | 29/755 X |
| 3,259,968 | 7/1966 | Dyksterhouse | 29/755 X |
| 3,842,496 | 10/1974 | Mercer | 29/755 X |
| 3,913,202 | 10/1975 | Pyle et al. | 29/755 X |
| 3,930,307 | 1/1976 | Schotthoefer et al. | 29/755 X |
| 4,711,025 | 12/1987 | De Santo | 29/755 X |
| 4,835,858 | 6/1989 | Adlon et al. | 29/755 X |

FOREIGN PATENT DOCUMENTS

| | | | |
|---|---|---|---|
| 561225 | 6/1977 | U.S.S.R. | 29/755 |

*Primary Examiner*—Carl J. Arbes

*Attorney, Agent, or Firm*—Jordan B. Bierman; Bierman, Muserlian and Lucas LLP

[57] ABSTRACT

A method of assembling complex wire harnesses wherein sub-assemblies of relatively simple circuits are made, terminals attached to the ends of each circuit, and the terminals are inserted into connectors. Each circuit is tested for integrity and, thereafter, the various circuits are placed together on a positioning board and bound with tape.

4 Claims, 5 Drawing Sheets

METHOD OF ASSEMBLING WIRE HARNESSES

This Application claims the benefit of the priority of Japanese 6-128691, filed Jun. 10, 1994.

The present Invention is directed to a method of assembling wire harnesses, more particularly those for use in connection with automotive vehicles. The novel method is intended to minimize or prevent mis-insertion of terminals into connectors and to improve the efficiency of assembling and testing.

BACKGROUND OF THE INVENTION

The prior art method for assembling wire harnesses is illustrated in FIGS. 5, 6A, 6B, 7A, 7B, and 7C. As particularly shown in FIG. 5, the wire harness has connectors A through E. First, wire group W-1, provided with connectors A, B, and D (FIG. 6A) is temporarily bound together. Wire groove W-2, having connectors C and E (FIG. 6B) is similarly temporarily bound. It should be noted that, in wire group W-1, terminal T1, which is to be attached to connector E of wire group W-2, remains exposed. Similarly, terminal T2 of wire group W-2, intended to be connected to wire group W-1, is also unattached.

After the temporary binding of the two wire groups (see FIG. 7A), wire group W-2 is placed on positioning board B for assembly. Thereafter, as shown in FIG. 7B, wire group W-1 is disposed on wire group W-2. At the same time, terminal T1 is inserted into connector E and terminal T2 is inserted into connector A. When the foregoing has been completed, wire groups W-1 and W-2 are wrapped in tape or the like, thereby completing the wire harness. Thereafter, the finished harness is tested for conductivity and integrity.

For ease in explanation, the foregoing prior art discussion has been limited to a single wire harness formed of only two temporarily bound wire groups. However, in usual practice, the wire harness is formed of dozens of wire groups. In assembling such a harness, the wire groups are placed on the positioning board sequentially and the exposed terminals of each group are connected to the corresponding connectors at that time. Thus, it is very easy to make a mistake and insert one or more terminals into the wrong connectors; this is particularly true when there are many temporarily bound wire groups and hence exposed terminals, the possibility of mis-insertion becoming exponentially greater with the increased number thereof.

Moreover, inserting a large number of exposed terminals increases the amount of work and lowers efficiency. Furthermore, the exposed terminals are vulnerable to deformation even to a point where it is difficult to insert them into their respective connectors. Also, the conductivity test is carried out only after the wire harness has been completed and all terminals have been secured in their connectors, since it is necessary to have the connectors in place in order to carry out the test. In this situation, if a harness is found to be defective, it is necessary for it to be completely taken apart and re-assembled. All of these disadvantages add to the difficulty and cost of production.

SUMMARY OF THE INVENTION

It is, therefore, among the objects of the present Invention to provide a method for assembling wire harnesses which will prevent or minimize mis-insertion by carrying out this step at a different point in the manufacture of the wire harnesses. Also, the present method can improve the efficiency of assembly by carrying out the conductivity test at an earlier stage than heretofore contemplated by the prior art.

In essence, the method of the present Invention comprises sub-assembling a plurality of at least one common harness, as well as preferably sub-assembling a plurality of at least one additional harness. Customarily, the common harness is one which is used in virtually all automotive vehicles, while the other harnesses are useful in a limited model or group of automotive vehicles.

The terminals of the sub-assembled harnesses are inserted into their corresponding connectors. Preferably, the sub-assemblies are individually tested at this point in the manufacture for circuit conductivity and integrity. Those which fail the test are rejected.

At least two sub-assembled and tested harnesses are placed on a positioning board, and permanently bound together by wrapping with material such as tape. It is particularly advantageous if two or more connectors, from different sub-assemblies, are combined to form compound connectors. This is most advantageously done prior to placement of the harnesses on the positioning board.

There are many advantages to the foregoing method. Since the testing is carried out before the harnesses are assembled, the defective portions can be discarded at an early stage, without the difficulty of dis-assembling a completed harness and trying to separate the defective portion from those which are satisfactory.

Moreover, it is easier manually, and there is less opportunity for mis-connection, because the sub-assemblies are simpler than the combined harness and there is less opportunity to make a mistake. Also, since all of the terminals have been inserted into their respective connectors before the sub-assemblies are combined to form the final harness, there is little or no danger that terminals will be bent or otherwise distorted. Also, when compound connectors are used, it further minimizes the chance of damage. Moreover, since the individual components have been previously tested, it is not necessary to further test the combined finished wire harnesses.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1A:
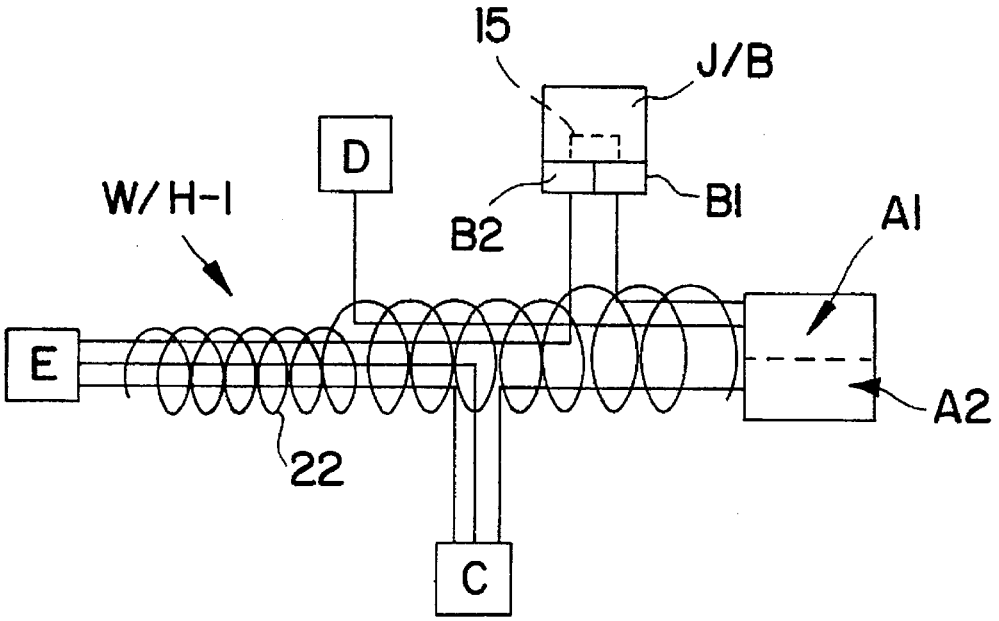
FIGS. 1A and 1B are schematic views of finished wire harnesses produced by the present Invention.
Figure 1B:
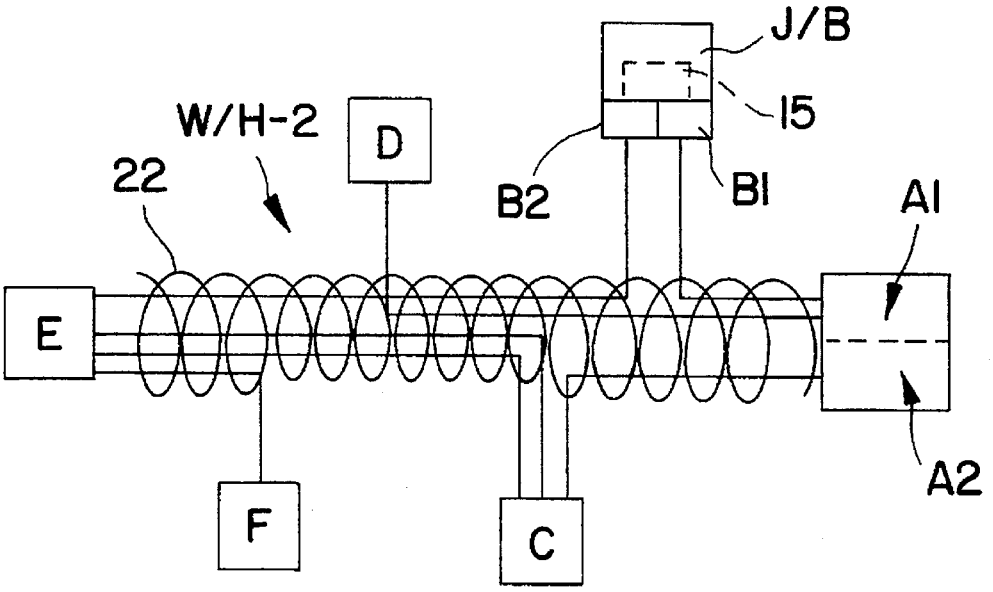
Figure 2A:
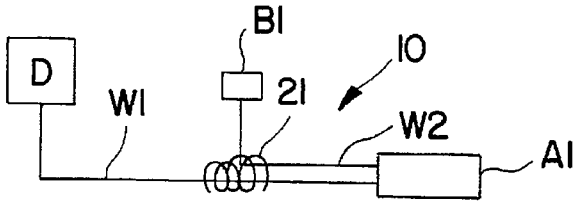
FIGS. 2A, 2B and 2C are schematic views of the sub-assemblies which are combined to form the harnesses of FIGS. 1A and 1B.

Referring to FIGS. 1 and 2, the harnesses of the present Invention are composed of a plurality of sub-assembled circuits. Each circuit comprises a wire having terminals press fitted on both ends. Thus, circuit W1 connects connector A1 with connector D, and circuit W2 connects connector A1 with connector B1. These together form common harness 10 as shown in FIG. 2A. All of the terminals of common harness 10 are inserted into connectors A1, B1, and D.

Figure 2B:
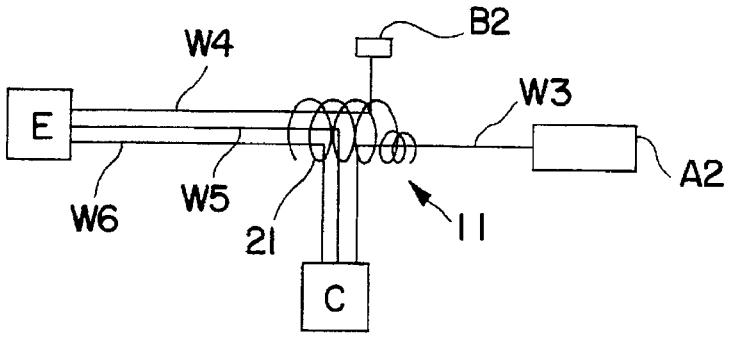
Figure 2C:
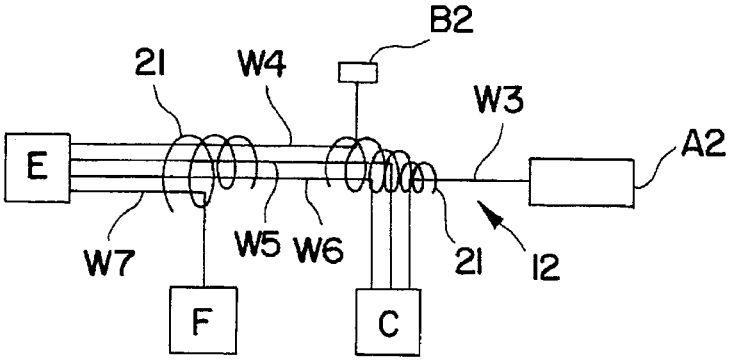
Figure 3:
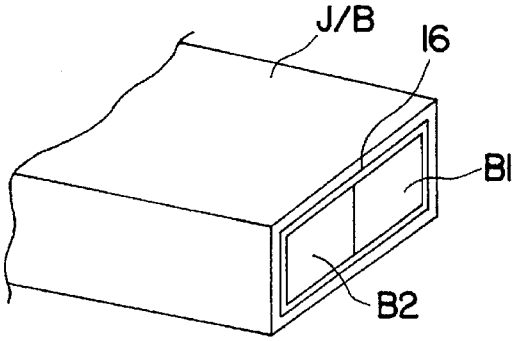
FIG. 3 is a perspective schematic view of a compound connector mounted in a junction box.

Similarly, as shown in FIG. 2B, circuits W3, W4, W5, and W6 have their respective terminals inserted into connectors A2, B2, C and E. A somewhat more complex sub-assembly is shown in FIG. 2C. There, in addition to the circuits of FIG. 2B, circuit W7 is included and its terminals are located in connectors E and F. Harnesses 10, 11, and 12 are bound with tape 21. As can be seen from a comparison of FIGS. 1A and 1B with FIGS. 2A, 2B, and 2C, common harness 10 forms a part of finished harness W/H-1 and W/H-2.

Figure 4:
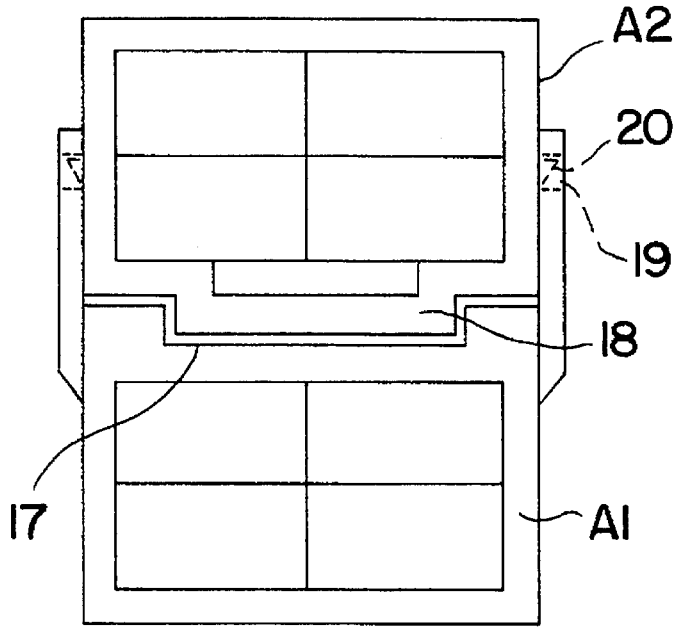
FIG. 4 is a schematic view showing one way of forming a compound connector from connectors of different harnesses.
Figure 5:
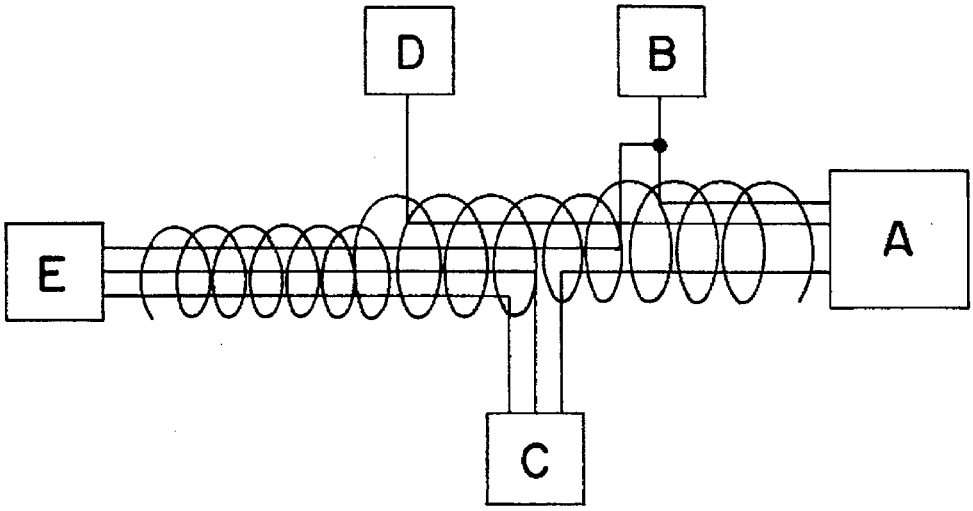
FIG. 5 PRIOR ART
FIG. 5 is a schematic view, similar to that of FIGS. 1A and 1B, of a harness produced in accordance with the prior art.
Figure 6A:
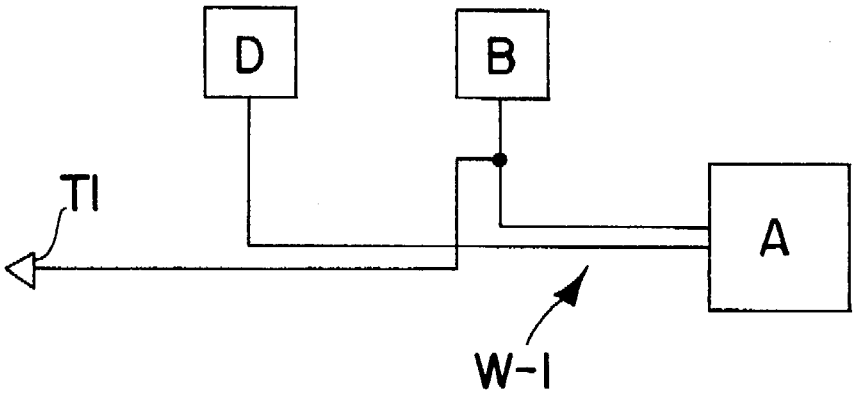
FIGS. 6A and 6B are schematic views, similar to those of FIGS. 2A, 2B, and 2C, of the prior art component harnesses which are combined to form the finished harness of FIG. 5.
Figure 6B:
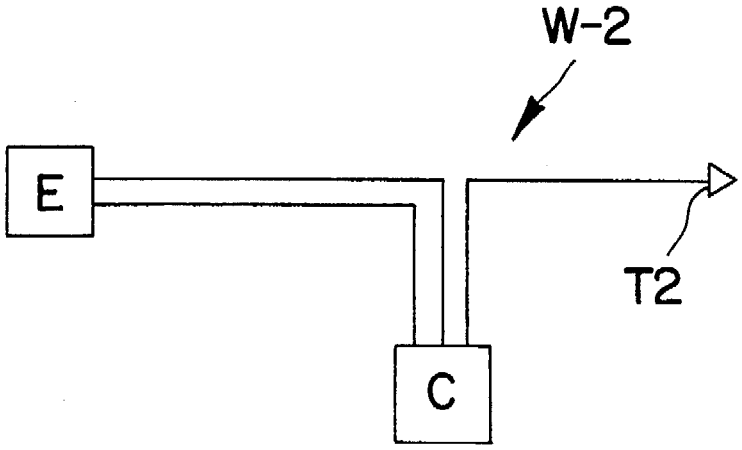
FIG. 6B PRIOR ART
Figure 7A:
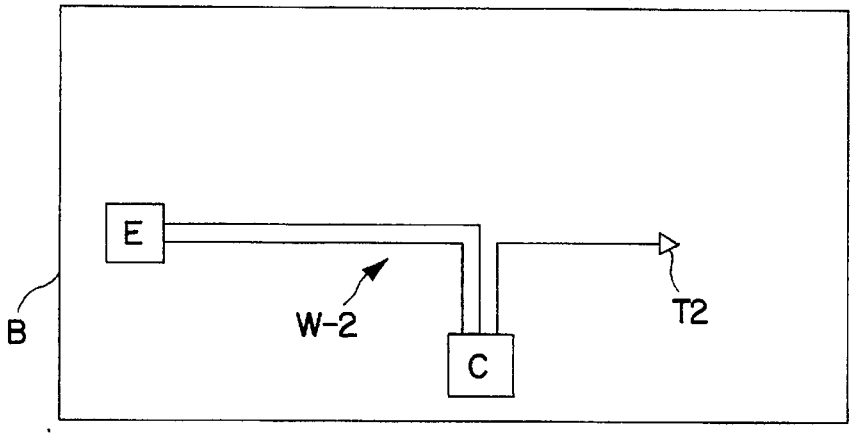
FIGS. 7A, 7B, and 7C illustrate the assembly of the components of FIGS. 6A and 6B to form the harness of FIG. 5.
Figure 7B:
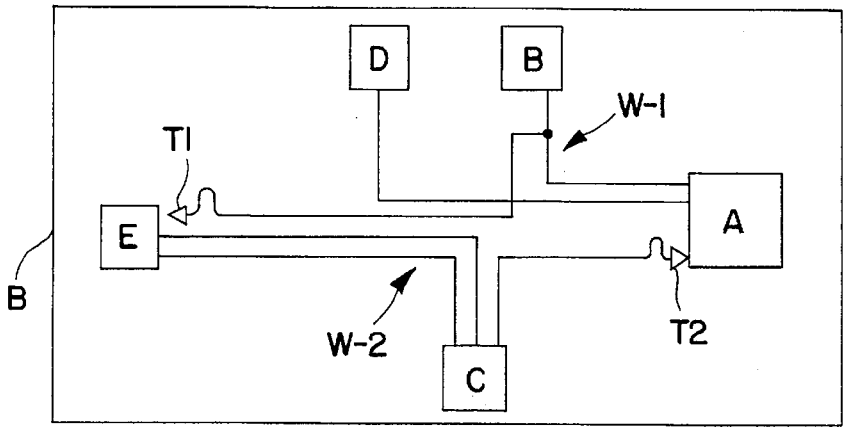
Figure 7C:
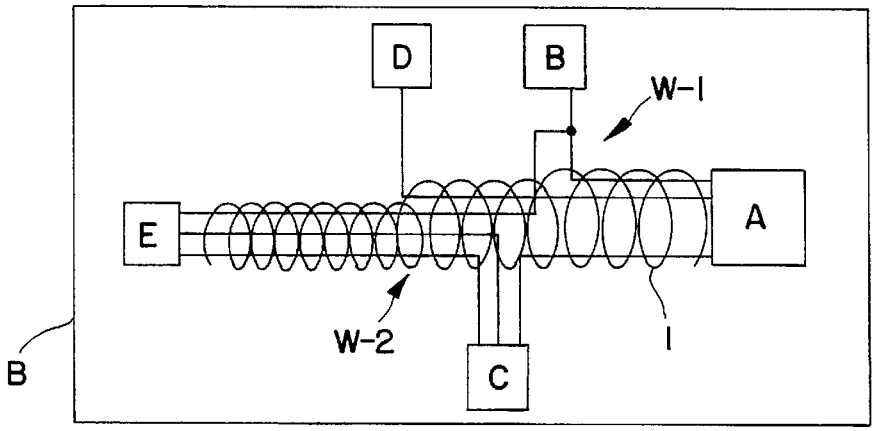
FIG. 7C PRIOR ART

Connectors B1 and B2 have been combined in receptacle 16 of compound connector J/B. They are electrically connected by bus bar 15. Similarly, connectors A1 and A2 are combined as shown in FIG. 4. Top groove 17 in connector A1 is adapted to receive tongue 18 extending downwardly from connector A2. In addition, side tongues 20 fit into side grooves 19 in order to additionally secure A1 to A2.

In accordance with the present Invention, circuits W1 to W7 are pre-assembled as shown in FIGS. 2A, 2B, and 2C. The terminals thereof are placed in connectors A1, A2, B1, B2, C, D, E, and F to form harnesses 10, 11, and 12. They are bound with tape 21. The individual circuits and sub-assemblies are tested for conductivity and circuit integrity. Thereafter, those which pass the test are placed on the positioning board for assembly into finished wire harnesses W/H-1 and W/H-2. Once in place, the sub-assemblies are bound by material 22 to form the unitary final product.

The foregoing method possesses numerous advantages. Since testing of the individual circuits has already been carried out, it is unnecessary to test the wire harnesses themselves. Moreover, defective components have previously been eliminated so that, if a defect is found, disassembly of a complex harness is unnecessary.

Using the method of the present Invention, it is relatively easy to deal with design changes in the individual circuits and/or the changes in size and characteristics of the overall wire harness. It is only necessary to replace the individual component, rather than the entire harness. Furthermore, all the terminals of the sub-assembled circuits are already within their respective connectors. Therefore, they do not have to be inserted on the positioning board, where there are many opportunities for misconnection and distortion of the terminals.

The present Invention also permits the combining of connectors in, for example, junction boxes whereby two circuits are connected prior to the formation of the completed harness on the positioning board. This increases efficiency and adds to the ability of the Invention to avoid mistakes. The final assembly consists of putting the sub-assemblies together and wrapping them with tape.

While only a limited number of specific embodiments of the present Invention have been expressly disclosed, it is, nonetheless, to be broadly construed and not to be limited except by the character of the clams appended hereto.

What we claim is:

1. A method of assembling a wire harness comprising (a) sub-assembling a plurality of at least one common harness, said common harness being adapted for use in automotive vehicles generally, each said common harness having at least two terminals, (b) sub-assembling a plurality of first harnesses, said first harnesses being adapted for use in certain automotive vehicles only, each of said first harnesses having at least two terminals, (c) inserting said terminals into their corresponding connectors, (d) combining at least one said common harness and at least one said first harness, (e) permanently winding a wrapping material around said common harness and said first harness.

2. The method of claim 1 wherein at least one of said corresponding connectors of said common harness is combined with at least one of said corresponding connectors of said first harnesses to form a compound connector prior to (d).

3. The method of claim 1 wherein said common harness and said first harnesses are subjected to a test for integrity of their circuits prior to (d), and (d) is carried using only those harnesses which pass said test.

4. The method of claim 1 further comprising (f) sub-assembling a plurality of second harnesses, said second harnesses being adapted for use in certain vehicles only, each of said second harnesses having at least two terminals.

* * * * *